US005873651A

United States Patent [19]

Hofer et al.

[11] Patent Number: 5,873,651

[45] Date of Patent: Feb. 23, 1999

[54] MINIATURE LIGHT BASE AND CONNECTOR THEREFOR

[76] Inventors: Richard D. Hofer, 5227 Bud La., Casco, Mich. 48064; Ronald A. Hofer, Jr., 26160 Hayes, Roseville, Mich. 48066

[21] Appl. No.: 834,631

[22] Filed: Apr. 14, 1997

[51] Int. Cl.[6] ..... F21V 21/08; F21L 15/16; F21L 15/18

[52] U.S. Cl. ..... 362/396; 362/397; 362/398

[58] Field of Search ..... 362/249, 396, 362/397, 398

[56] References Cited

U.S. PATENT DOCUMENTS

| | | | |
|---|---|---|---|
| 1,955,273 | 4/1934 | Cleburne | 362/397 |
| 3,340,390 | 9/1967 | Imre | 362/396 |
| 4,491,902 | 1/1985 | Cangelosi | 362/396 |
| 4,547,840 | 10/1985 | Tinder | 362/296 |
| 4,841,420 | 6/1989 | Baggio et al. | 362/249 |
| 4,901,960 | 2/1990 | Gary | 248/205.3 |
| 4,962,907 | 10/1990 | Gary | 248/205.3 |
| 5,036,447 | 7/1991 | Taylor | 362/249 |
| 5,110,078 | 5/1992 | Gary | 248/206.2 |
| 5,142,461 | 8/1992 | Nugent | 362/396 |
| 5,295,055 | 3/1994 | Brock et al. | 362/397 |
| 5,446,640 | 8/1995 | Lin | 362/249 |
| 5,481,444 | 1/1996 | Schultz | 362/249 |
| 5,562,269 | 10/1996 | Protz, Jr. | 248/74.2 |
| 5,580,159 | 12/1996 | Liu | 362/249 |

OTHER PUBLICATIONS

Suction cup products of Suction Cups Japan Co., Ltd, 4 sheets showing Pit Hole, Welder, Side Groove, and Both types, dated 1996, believed public before Apr. 14, 1996.

Suction cup and Connector product shown at Figure 1 of Applicants' Specification, manufacturer unknown, believed public before Apr. 14, 1996.

*Primary Examiner*—Alan Cariaso
*Attorney, Agent, or Firm*—Peter D. Keefe

[57] ABSTRACT

A miniature light base is directly connected to a connector therefor. A first preferred form of miniature light base according to the present invention utilizes a male or female connection member to directly connect to a correspondingly reciprocal male or female connection member of a connector. A second preferred form of miniature light base according to the present invention utilizes an adhesion agent to directly attach a connector to the base. The miniature light base is otherwise characterized by the generally conventional aspects of a socket for receiving a lamp member and electrical contacts within the socket for electrically contacting the electrode wires of the lamp member. The connector is any article which serves to connect the base supportively to a support structure, such as for example a window, eaves or a gutter.

2 Claims, 2 Drawing Sheets

MINIATURE LIGHT BASE AND CONNECTOR THEREFOR

BACKGROUND OF THE INVENTION

1. Field of the Invention

The present invention relates to miniature lights of the kind commonly used for decorating at Christmas time. More particularly, the present invention relates to a base of a miniature light which is directly connectable to a connector, such as for example a suction cup, magnet, hook, or adhesive pad, without resort to an intermediary device to achieve the connection therebetween.

2. Description of the Prior Art

Miniature lights are arranged in a wired string of, for example, 25, 50, 100 or even more lights. The lights themselves are small, yet the illumination given off is extremely pleasing, particularly when the colors of the lights and/or the blinking of the lights are predetermined to provide a desired over-all pleasing look. These strings of miniature lights are easily wrapped in an intertwined relation to the branches of an evergreen or other similar kind of object. However, placement of the miniature lights in relation to an object having no inherent supporting members, such as along a window or eaves, is rather difficult. Frequently, the user must use tape or some kind of a homemade hook-like structure for interfacing between the wires of the string and the object.

The typical construction of a miniature light 10 is depicted at FIG. 1. An incandescent lamp 12 has a pair of electrode wires depending from the glass bulb 14 thereof. A plastic base 16 includes a socket and electrical connection between wires 18 of the string and electrical contacts inside the socket. The most common miniature light includes a seat 20 for the lower portion of the lamp in which the electrode wires of the lamp are externally seated. The seat is received snugly into the socket, whereby the electrode wires make electrical contact with the electrical contacts. In another version of miniature light, the lower portion of the lamp fits directly into the socket of the base, wherein the electrode wires make electrical connection with the electrical contacts. The base is generally of cylindrical shape which optionally includes opposing flats 22, and offers no particular structural feature for interfacing with any other object. The term "lamp member" hereinafter refers to a lamp or to a lamp with seat.

In the prior art, it is known to connect a connector in the form of a suction cup with the base of a miniature light using an intermediary device in the form of a resilient clip which clippably engages the base in a perpendicular orientation, and which, itself, is connected with a suction cup. An example of such a clip structure is presented in U.S. Pat. No. 5,110,078 to Gary, dated May 5, 1992. A product that is currently on the market having this kind of intermediary device is shown at 24 in FIG. 1. A resilient pair of arms 26, 28 clippably receive the base 16. A male interconnection member 30 (in the form of a projection with a bossed head) is provided on the intermediary device 24 which mates with a female interconnection member 32 (in the form of a pit hole) formed in the rear of the suction cup 34. A variation on this intermediary device theme is described in U.S. Pat. No. 5,562,269 to Protz, Jr., dated Oct. 8, 1996, wherein the base is received axially into a holder which, in turn, connects with a suction cup. While intermediary devices are quite usable for the purpose to which they are intended, they suffer from being an additional part which could get lost and in any event adds an undesirable increase in cost of interfacing a connector to the base of miniature lights.

Accordingly, what remains needed in the art is some way to directly connect the base of a miniature light to a connector without need of an intermediary device.

SUMMARY OF THE INVENTION

The present invention pertains to a direct connection for connecting a base of a miniature light directly to a connector therefor. A first preferred form of miniature light base according to the present invention utilizes a male or female connection member to directly connect to a correspondingly reciprocal male or female connection member of a connector. A second preferred form of miniature light base according to the present invention utilizes an adhesion agent to directly attach a connector to the base. The miniature light base is otherwise characterized by the generally conventional aspects of a socket for receiving a lamp member and electrical contacts within the socket for electrically contacting the electrode wires of the lamp member. The connector is any article which serves to connect the base supportively to a support structure, such as for example a window, eaves or a gutter.

With regard to the first form of the direct connection according to the present invention, the base has integrally formed one or more male or female connection members for matingly engaging a correspondingly reciprocal male or female connection member formed with a connector, such as for example a suction cup, a magnet, a clip or an adhesive pad. The female connection member is in the preferred form of a hole formed in the side wall and/or the bottom wall of the base. The male connection member is in the preferred form of a projection formed at the side wall and/or bottom wall of the base, wherein the projection projects perpendicularly from a surface of the base and terminates with a bossed head. In operation of the first form of the direct connection, a connector, such as for example a suction cup, a magnet, a clip, or an adhesive pad has a correspondingly reciprocal male or female connection member with respect to the aforementioned male or female connection member of the base, wherein a connective interfit is provided directly therebetween.

With regard to the second form of direct connection according to the present invention, a first surface of the base is affixed directly to a second surface of a connection member via an adhesion agent, such as for example by an adhesive or sonic welding.

Accordingly, it is an object of the present invention to provide direct connection of a miniature light base to a connector.

It is an additional object of the present invention to provide a male or female connection member integral with the base of a miniature light, whereby the base is directly connectable to a correspondingly reciprocal male or female connection member of a connector.

It is a further object of the present invention to provide one of more male or female connection members formed integrally with a base of a miniature light to thereby connect the base to one or more connectors having a correspondingly reciprocal male or female connection member relative to that of the base.

It is yet another object of the present invention to provide one of more male or female connection members formed integrally with a base of a miniature light to thereby connect the base to one or more connectors having a correspondingly reciprocal male or female connection member with respect to that of the base, wherein the connector includes at least one of a suction cup, a magnet, a hook or an adhesive pad.

It is still another object of the present invention to provide direct affixment of a base of a miniature light to a connector, whereby the base is directly adhered to the connector, wherein the connector includes at least one of a suction cup, a magnet, a hook or an adhesive pad.

These, and additional objects, advantages, features and benefits of the present invention will become apparent from the following specification.

DETAILED DESCRIPTION OF THE PREFERRED EMBODIMENT

Figure 1:
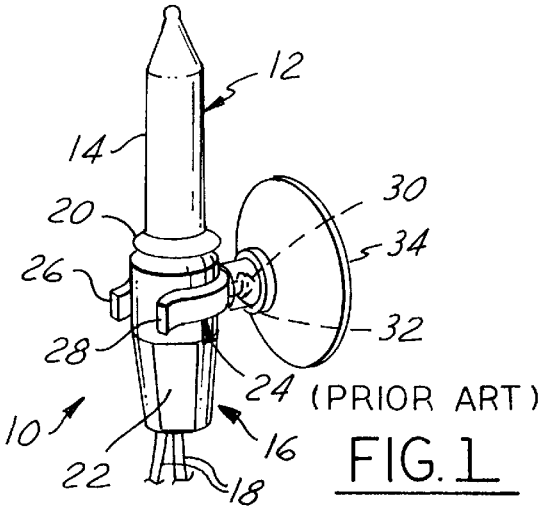
(PRIOR ART) FIG. 1
FIG. 1 is a perspective view of a prior art miniature light, prior art intermediary device for clipping to the base of the miniature light and a prior art suction cup type connector connected with the intermediary device.

Referring now to the Drawing, FIGS. 2 through 10A generally depict preferred examples of direct connection according to the present invention for directly connecting a base of a miniature light to an article, particularly, a connector. In this regard, by the term "connector" is meant an article structured to, in turn, connect to any structural member so as to thereby support the miniature light base and the string of miniature lights to which it forms a part, such as for example a suction cup, a magnet, a hook or an adhesive pad. A first form of direct connection according to the present invention involves connecting a base to a connector via a male to female connection member interface therebetween. A second form of direct connection according to the present invention involves connecting a base to a connector via an adhesion agent.

Figure 2:
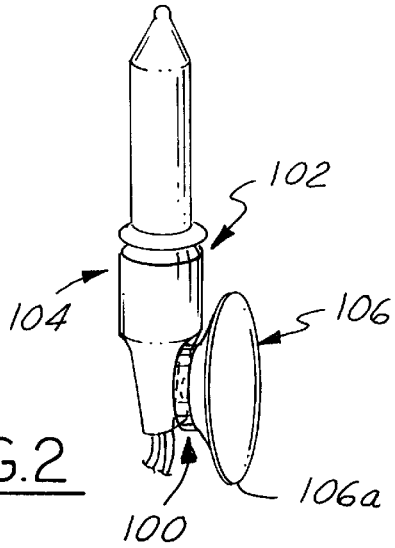
FIG. 2 is a perspective view of a miniature light having a base according to the present invention, shown in operation wherein the base is directly connected to a suction cup type connector via a first form of direct connection.
Figure 3:
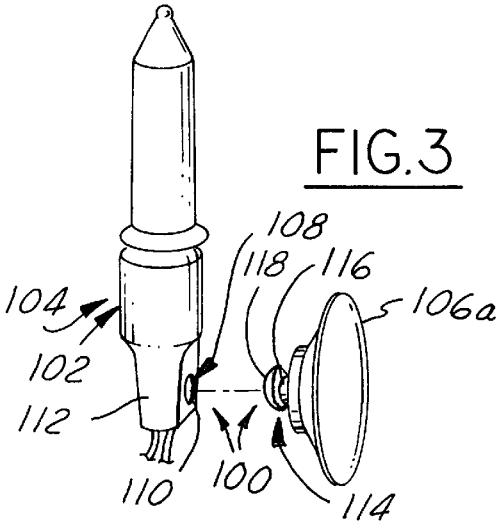
FIG. 3 is a perspective, exploded view of a miniature light having a base according to the present invention and a suction cup type connector, wherein the base is provided with a female connection member and the suction cup is provided with a counterpart male connection member according to the first form of direct connection.
Figure 4:
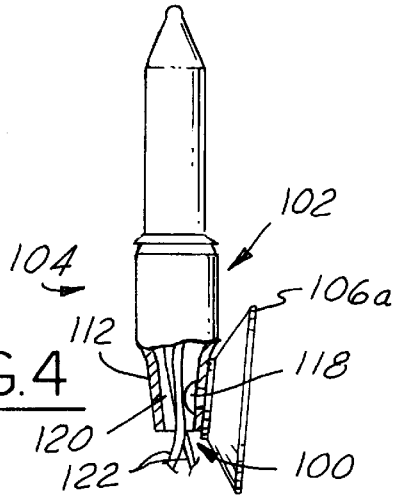
FIG. 4 is a partly sectional side view of a miniature light base and suction cup of FIG. 3 shown mated together.

A direct connection 100 of a base 102 of a miniature light 104 to a connector 106 according to a first example of the first form thereof is shown at FIGS. 2 through 4. A female connection member 108 is provided integrally with the base 102 via a hole 110. The hole 110 passes through the side wall 112 of the base 102 into the interior hollow 120 thereof. A male connection member 114 is provided at the rear of a connector 106 in the form of a suction cup 106*a* via a projection 116 having a bossed head 118. The bossed head 118 has a cross-section larger than that of the hole 110, but is resiliently deformable sufficiently to be insertable thereinto. The shape of the bossed head 110 is such that it will interferingly abut the side wall 112 of the base 102 when it has entered into the interior hollow 120. The female connection member 108 may or may not be placed at a flat of the base (as referenced hereinabove), although it is desirable from a stability point of view.

In operation, either an end user or the manufacturer causes the projection 116 to enter receivingly into the hole 110, as initially shown at FIG. 3. The projection 116 is inserted until the bossed head 118 has reached into the hollow 120 and is in interfering abutment with respect to the inside of the side wall 112, whereat the male and female connection members are connectively interfitted. Depending on the cross-sectional size of the bossed head 118 relative to the diameter of the hole 110, extraction of the projection 116 from the hole may be either accomplished easily, with great difficulty, or not at all without destroying or damaging the components. The female connection member 108 is preferably provided at a lower portion of the base 102 so that the bossed head 110 of the male connection member 114 will avoid insertion interference with respect to the lamp member of the miniature light when it is being seated into the base.

It will be noted from a comparative viewing of FIGS. 2 and 4 that the miniature light 104 is only minimally encumbered by the connection member 106, in that there is no intermediary device. Further, the cost of making is minimal, again because an intermediary device is obviated. Lastly, it will be noted that even though the bossed head 118 is resident in the hollow 120, there is still plenty of room for the wires 122 to pass therearound in the hollow and exit out from the base 102.

Figure 5:
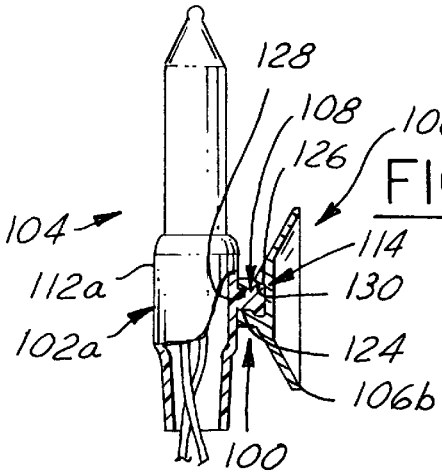
FIG. 5 is a partly sectional side view of a miniature light having a base according to the present invention and a suction cup type connector, wherein the base is provided with a male connection member and the suction cup is provided with a counterpart female connection member according to the first form of direct connection.

A direct connection 100 of a base 102*a* of a miniature light 104 to a connector 106 according to a second example of the first form thereof is shown at FIG. 5. A male connection member 114 is provided integrally with the base 102*a* via a projection 124 having a bossed head 126. The projection 124 perpendicularly projects from the local surface of the side wall 112*a*. A female connection member 108 is provided at the rear of a connection member 106 in the form of a suction cup 106*b* via a pit hole 128 having an enlarged portion at its blind end, hereinafter referred to as a pit 130.

In operation, either an end user or the manufacturer causes the projection 124 to enter receivingly into the pit hole 128 until (analogously to the interconnection described hereinabove with respect to FIGS. 2 through 4) the bossed head 126 has reached into the pit 130 and is in interfering abutment with respect to the material at the demarcation between the reduced diameter portion of the pit hole 128 and the greater diameter of the pit 130. Now, the male and female connection members are connectively interfitted. Depending on the cross-sectional size of the bossed head 126 relative to the diameter of the reduced diameter portion of the pit hole 128, extraction of the projection 124 from the pit hole may be either accomplished easily, with great difficulty, or not at all without destroying or damaging the components. Where the male connection member 114 is integral with the base 102, it may be located anywhere on the base, since there is no problem with interference of the female connection member of the connector with respect to the lamp member of the miniature light.

The advantages of the first example of the first form of direct connection recited above regarding minimal encumbrance and minimal cost also pertain to the second example of the first form of the direct connection.

Figure 6:
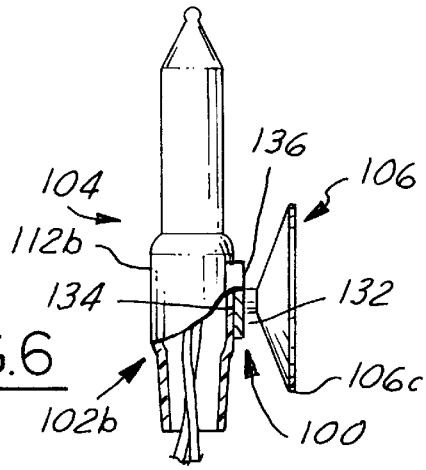
FIG. 6 is a partly sectional side view of a miniature light and suction cup type connector, wherein the suction cup is adhesively attached to the base of the miniature light via a second form of direct connection.

A direct connection 100 of a base 102*b* of a miniature light 104 to a connector 106 according to the second form thereof is shown at FIG. 6. A first surface 132 on the side wall 112*b* of the base 102*b* is provided. A second surface 134 is provided at the rear of a connector 106 in the form of a suction cup 106*c*. The first and second surfaces 132, 134 are mutually connected together by an adhesion agent 136. Examples of adhesion agents 136 include adhesives (glues) or sonic welding.

In operation, either an end user or the manufacturer adhesively joins the first and second surfaces 132, 134 so as to thereby directly mount the suction cup 106*c* to the base 102*b*. Where an adhesive is used as the adhesion agent 136, the adhesive may be permanent or selectively releasable. Depending on the choice of adhesive, later separation of the first surface 132 from the second surface 134 may be either accomplished easily, with great difficulty, or not at all without destroying or damaging the components. The first and second surfaces are congruently shaped to be mutually abuttable, such as for example the second surface 134 having a concave contour for matching the cylindrical curve of the base, or flat for matching a flat of the base.

Again, it will be noted that the miniature light 14 is only minimally encumbered, there being no intermediary device; and that the cost of making is minimal.

Direct connection 100 of a base of a miniature light to a connector will be discussed relative to a number of variations of the two forms thereof, with reference being directed to FIGS. 7 though 10A. In this regard, it will be understood that the various connectors 106 shown are merely by way of example and that an exhaustive discussion of every possible connector is not only impractical, but is unnecessary to those of ordinary skill to practice the direct connection 100 according to the present invention after having become familiar with the various described and shown examples. Further, in view of the hereinabove detailed description of the male-female connection member interfaces, repetition hereinbelow of these structural aspects for effecting interfit therebetween is not required for an understanding thereof.

Figure 7:
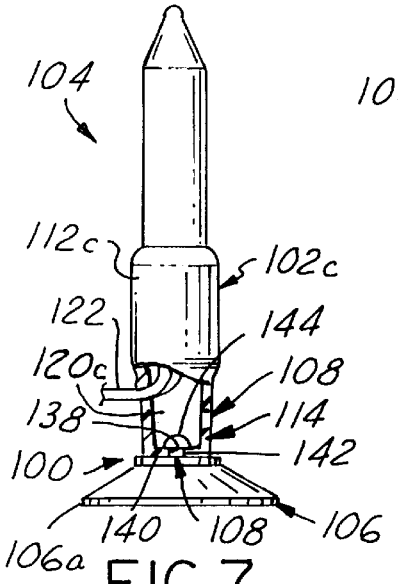
FIG. 7 is a partly sectional side view of a miniature light base having a female connection member located at the bottom wall thereof shown engaged with respect to a counterpart male connection member of a suction cup type connector according to the first form of direct connection.

FIG. 7 depicts a miniature light 104 in which the direct connection 100 involves the first form thereof via male and female connection members 114, 108. The base 102*c* is provided with a female connection member 108 in the form of a hole 138 located at the bottom wall 140 of the base, wherein the hole passes through the bottom wall into the interior hollow 120*c* of the base. A reciprocally corresponding male connection member 114 in the form of a projection 142 with bossed head 144 is provided at the rear of a connector 106 in the form of a suction cup 106*a*. The wires 122 of the miniature light 104 exit the side wall 112*c* above the bottom wall 140. An optional second female connection member 108 is shown at the side wall 112*c*. In operation, the user inserts the projection 142 into the hole 138 so that the bossed head 144 becomes trapped by abutment thereof with the base wall adjacent the hole, whereupon a connective interfit therebetween is provided.

Figure 8:
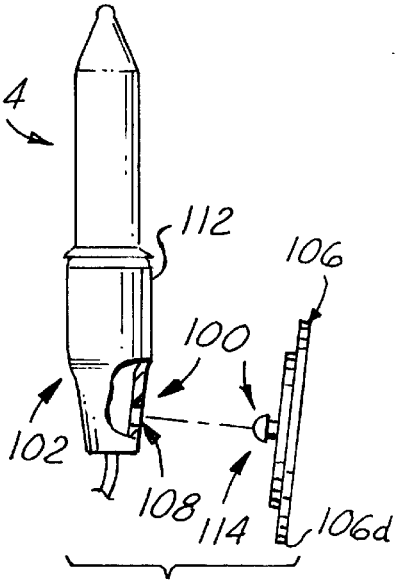
FIG. 8 is a partly sectional, exploded side view of a miniature light having a base provided with a female connection member and a connector in the form of a magnet having a counterpart male connection member according to the first form of direct connection.
Figure 8A:
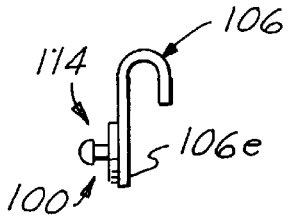
FIG. 8A is a side view of a connector in the form of a hook having a male connection member for connecting with the base of FIG. 8.
Figure 8B:
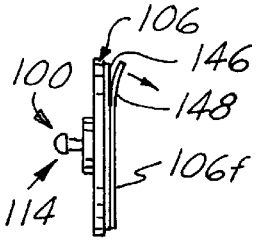
FIG. 8B is a side view of a connector in the form of an adhesive pad having a male connection member for connecting with the base of FIG. 8.

Referring now to FIGS. 8 through 8B, the miniature light 104 depicted in FIGS. 2 through 4 is now shown in which the direct connection 100 involves the first form thereof via male and female connection members 114, 108 as at FIGS. 2 through 4, but now the base 102 is connectable to other kinds of connectors 106. By way of exemplification and not limitation, the other kinds of connectors are: a magnet 106*d* (FIG. 8), a hook 106*e* (FIG. 8A), and an adhesive pad 106*f* (FIG. 8B). The magnet 106*d* is, for example, in the preferred form of a flat, flexible magnetized pad, of the kind referred to commonly as "refrigerator magnets". The hook 106*e* includes a bent portion for hooking onto an object. The adhesive pad 106*f* has a sticky surface 146 which is protected by a peelable sheet 148. A preferred material for providing the sticky surface 146 is foam having double sided sticky adhesive. Operation of the male and female connection members 114, 108 is as described with respect to FIGS. 2 through 4.

Figure 9:
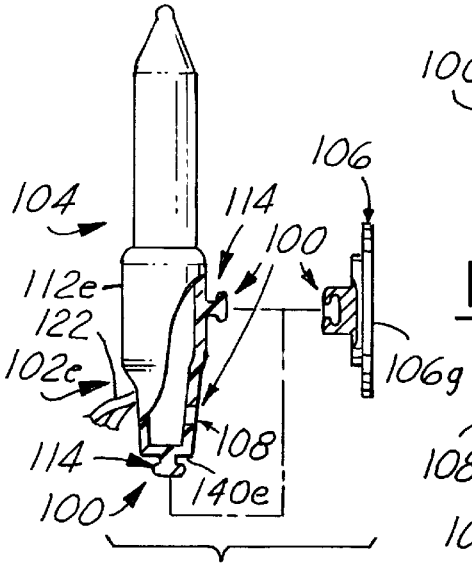
FIG. 9 is a partly sectional, exploded side view of a miniature light having a base provided with dual male connection members, a female connection member and a connector in the form of a magnet having a counterpart female connection member according to the first form of direct connection.
Figure 9A:
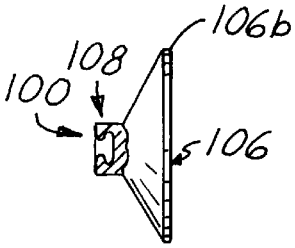
FIG. 9A is a partly sectional side view of a connector in the form of a suction cup having a female connection member for connecting with the base of FIG. 9.
Figure 9B:
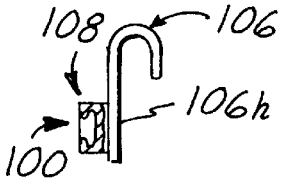
FIG. 9B is a partly sectional side view of a connector in the form of a hook having a female connection member for connecting to the base of FIG. 9.
Figure 9C:
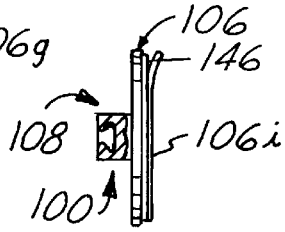
FIG. 9C is a side view of a connector in the form of an adhesive pad having a female connection member for connecting to the base of FIG. 9.

Referring now to FIGS. 9 through 9C, the miniature light 104 has a base 102*e* wherein the direct connection 100 involves a plurality of male connection members 114 integrally connected with the base 102*e* and a female connector member 108 structured as described with respect to FIG. 8. Each male connection member 114 is structured as described with respect to FIG. 5, having a projection and a bossed head, wherein one of the male connection members is located on the side wall 112*e* and the other is located at the bottom wall 140*e*. Each correspondingly reciprocal female connection member 108 is as described with respect to FIG. 5, but is now shown with regard to various kinds of connection members 106. By way of exemplification and not limitation, the kinds of connection members are: a magnet 106*g* (FIG. 9), a suction cup 106*b* (FIG. 9A), a hook 106*h* (FIG. 9B), and an adhesive pad 106*i* (FIG. 9C) having a sticky surface 146, the structural features of which have been previously described.

Figure 10A:
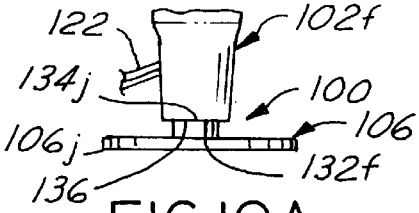
FIG. 10A is a broken away view of the base of FIG. 10, wherein now a magnet type connector is shown connected thereto according to the second form of direct connection.
Figure 10:
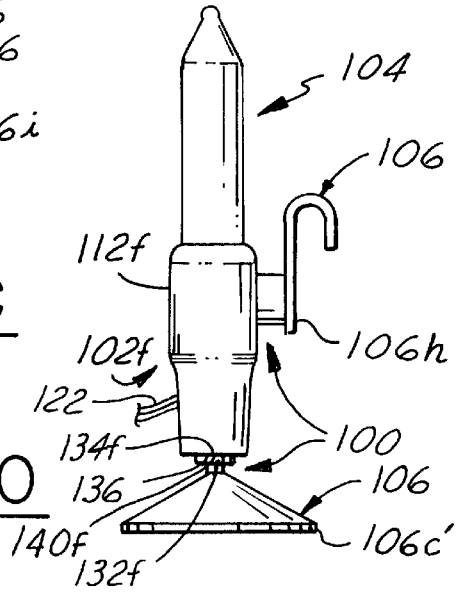
FIG. 10 is a side view of a miniature light, wherein the base according to the present invention is directly connected with respect to two connectors, one connector in the form of a hook connected to the base via the first form of direct connection, the other connector in the form of a suction cup connected to the base via the second form of direct connection.

FIGS. 10 and 10A depict a miniature light 104 wherein the direct connection 100 is in dual operation. At FIG. 10, the bottom wall 140*f* is provided with a first surface 132*f* for connecting with a second surface 134*f* of a connector 106 in the form of a suction cup 106*c'*. The first and second surfaces are connected by an adhesion agent 136 as described hereinabove. The side wall 112*f* is provided with an integral male connection member which interfits with a female connection member of a connector 106 in the form of a hook 106*h*, wherein the interfit between the male and female connectors is as described with respect to FIG. 5. The wires 122 exit the base 102*f* through the side wall 112*f* in the manner discussed relative to FIG. 7. FIG. 10A depicts a variation of FIG. 10, wherein the connector 106 is in the form of a magnet 106*j* having a second surface 134*j* which is adhered via the adhesive agent 136 to the first surface 132*f*.

It is to be understood that the second form of direct connection 100 according to the present invention, in which a first surface of a base is connected by an adhesive agent to a second surface of a connector, the connector can be any form of connector, including but not limited to a suction cup, a magnet, a hook or an adhesive pad.

It is to be further understood that the direct connection 100 is usable with various structural variations of both the base of the miniature light and the connectors. For example, a base might have both a male and a female connection members. Further for example, more than one connector may be connected to a base, wherein the direct connection 100 may be, respectfully, of differing forms. Still further for example, where more than one connector is connected to a miniature light base, the connectors may or may not be of the same form; ie., one might be a suction cup, while another is a magnet, or one might be a hook and the other is an adhesive pad, etc.

It is further to be understood that miniature lights may be manufactured having bases with either male or female connection members, awaiting an end user to select and join thereto a connection member having the correspondingly reciprocal male or female connection member of the connector.

To those skilled in the art to which this invention appertains, the above described preferred embodiment may be subject to change or modification. For example, while the direct connection 100 is described relative to a connector, the direct connection may be similarly effected with respect to any article. Such change or modification can be carried out without departing from the scope of the invention, which is intended to be limited only by the scope of the appended claims.

What is claimed is:

1. A miniature light base having a connection member for directly connecting the miniature light base to an article, said miniature light base comprising:

a single piece miniature light base having an integral bottom wall and an integral side wall;

a first male connection member integral with said bottom wall; and a second male connection member integral with said side wall;

wherein said first and second male connection members provide connection locations for said base to at least one selected article; and wherein each of said first and second male connection members comprises a projection which projects from said surface of said base, said projection having a bossed head distally disposed from said surface.

2. The miniature light base of claim 1, wherein said at least one article is selected from the group consisting of: a suction cup, a magnet, a hook and an adhesive pad.

* * * * *